United States Patent [19]

Brossette

[11] 4,305,472

[45] Dec. 15, 1981

[54] APPARATUS FOR RECORDING AND LIMITING TORQUE

[76] Inventor: McKinley J. Brossette, 119 N. Hollywood Rd., Houma, La. 70360

[21] Appl. No.: 131,285

[22] Filed: Mar. 18, 1980

[51] Int. Cl.[3] ..... B25B 23/14

[52] U.S. Cl. ..... 173/12; 73/862.23; 81/470; 91/59

[58] Field of Search ..... 173/12; 81/470; 73/139; 91/59

[56] References Cited

U.S. PATENT DOCUMENTS

| | | | |
|---|---|---|---|
| 3,097,551 | 7/1963 | Schmitt | 81/470 |
| 3,693,727 | 9/1972 | Bell | 173/12 |
| 3,719,236 | 3/1973 | Smith, Jr. et al. | 173/12 |
| 3,719,237 | 3/1973 | Flick | 173/12 |
| 3,745,820 | 7/1973 | Weiner | 173/12 X |
| 4,199,032 | 4/1980 | Weiner et al. | 173/12 |

*Primary Examiner*—Robert Mackey
*Attorney, Agent, or Firm*—Jonathan E. Jobe, Jr.

[57] ABSTRACT

Apparatus for recording and limiting the torque applied to a pipe by a set of power tongs, wherein the tongs are operated by a hydraulic fluid pumped through a feed line to a hydraulic motor in the tongs and then returned by a return line. The apparatus includes a hydraulic tension cell attached between the tongs and a fixed attachment whereby torque applied by the tongs causes hydraulic pressure in the tension cell proportional to the torque applied. The tension cell is hydraulically connected to a helical pressure sensor tube. An operating arm is attached to the pressure sensor tube such that hydraulic pressure in the hydraulic tension cell causes the operating arm to rotate in an amount proportional to the pressure and therefore the torque. The operating arm is cammingly engaged with a spring arm which in turn is engaged with an air valve. The closure of the air valve causes the opening of a shunting valve between the feed line and return line, which shunts fluid between the lines, thereby bypassing the motor and limiting the torque.

9 Claims, 6 Drawing Figures

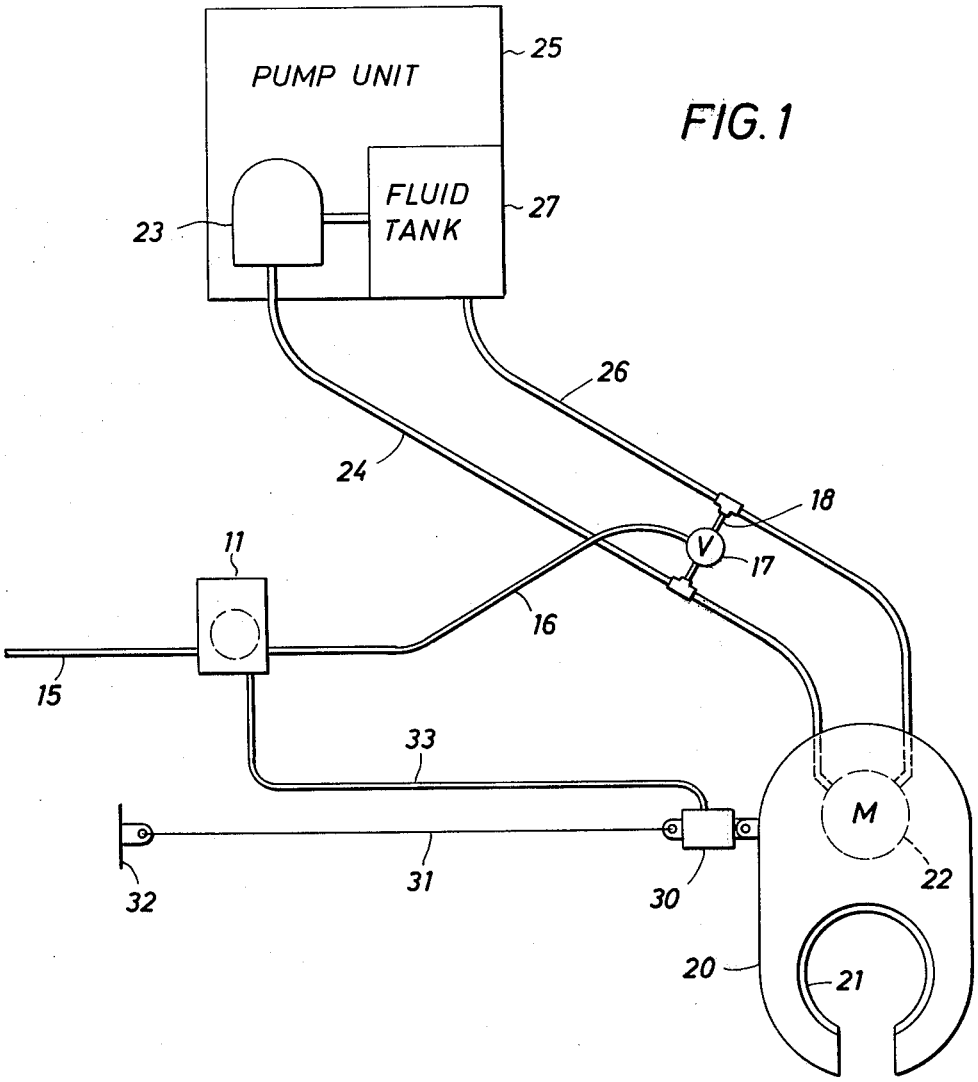
FIG. 1
FIG. 4
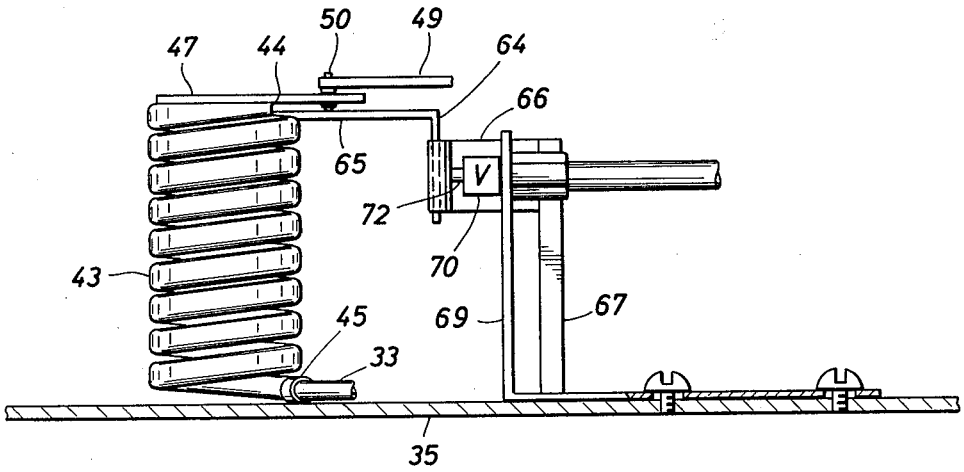

FIG. 3
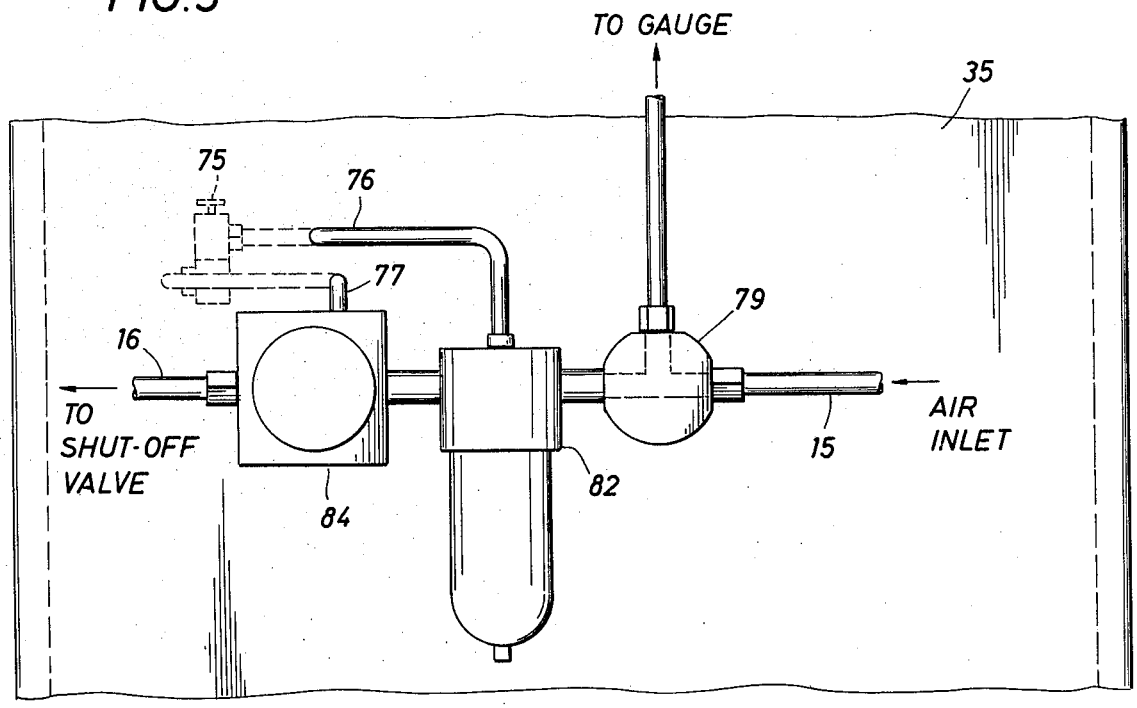
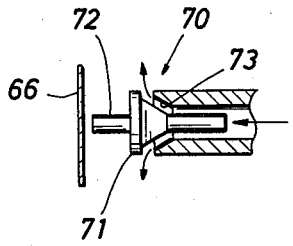
FIG. 5
FIG. 6
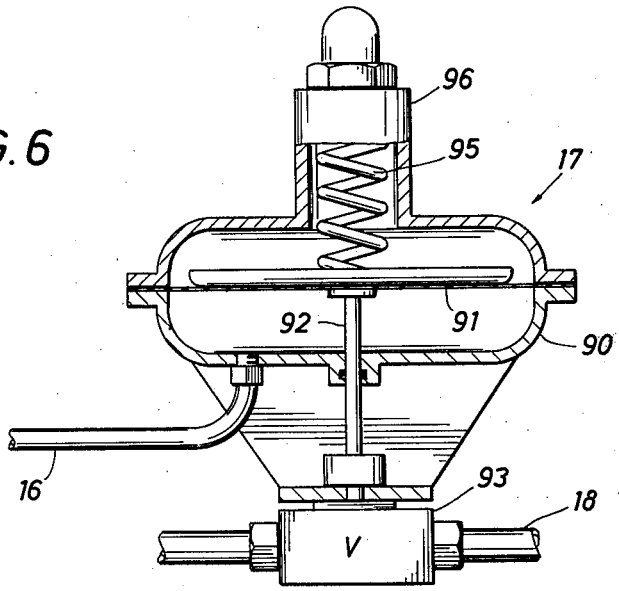

APPARATUS FOR RECORDING AND LIMITING TORQUE

BACKGROUND OF THE INVENTION

A. Field of the Invention

The present invention relates generally to torque-limiting apparatus and more particularly to a hydraulically operated apparatus with recording means.

B. Description of the Prior Art

In the oil and gas well drilling and completion industries, sections of pipe are connected together to form long strings. Sections of drill pipe are connected together by means of tool joints, which comprise a pin and box. Casing is normally assembled by means of casing collars, which are short sections of pipe having female threads at both ends. Both drill pipe and casing are normally made up with mechanical devices known as power tongs, which are normally hydraulically-operated torque-applying devices.

The torque applied in making up sections of pipe must be carefully controlled in order to prevent too much torque from being applied to the pipe and the possible consequent twisting off of the pipe or stripping of the threads. If the threads become stripped, then it is distinctly possible that the string of pipe can be dropped into the hole, thereby necessitating a costly fishing job.

Normally, the operator requires that a record be kept of the torque applied to each connection. The torque is measured by means of a hydraulic tension cell placed between the power tongs and a fixed attachment. The torque is proportional to the hydraulic pressure generated in the cell and hydraulic recording means are provided that convert pressure and record torque. The record of torque applied is useful in determining whether a mishap is due to operator error or defective pipe. However, having a record that the lost pipe was caused by excessive torque does not eliminate the fishing job.

Accordingly, it is an object of the present invention to provide a recording apparatus with means for limiting the torque applied to the pipe.

SUMMARY OF THE INVENTION

In the present invention, the torque applied to the pipe is measured hydraulically. A tension cell is attached between the power tongs and a fixed attachment. The tension cell is hydraulically connected to a helical pressure sensor tube. Torque applied by the power tongs causes a proportional pressure to be generated by the tension cell. The pressure in the tension cell causes a helical sensor tube to twist in an amount proportional to the pressure in the cell and therefore the torque applied by the tongs. The torque is recorded upon a chart by a stylus linked to the pressure sensor tube.

The pressure-limiting means of the present invention includes an operating arm attached to the pressure sensor tube, which rotates in an amount proportional to the torque applied by the tongs. The operating arm is cammingly engaged with a spring, which in turn is engaged with an air valve operator. The rotation of the operating arm causes the spring to move and close the air valve. The closure of the air valve causes a shunting valve located between the feed line and the return line to open and shunt hydraulic fluid between the lines and thereby bypass the motor and the power tongs. The shunting of hydraulic fluid limits the torque applied by the tongs.

BRIEF DESCRIPTION OF THE DRAWINGS

FIG. 1 is a schematic drawing showing the major components of the system of the present invention.

FIG. 3 is a view showing the air supply ducting of the present invention.

FIG. 4 is a view showing details of the pressure measuring device of the present invention.

FIG. 5 is a view showing details of the air valve of the present invention.

FIG. 6 is a view showing details of the diaphragm-operated shunting valve.

DESCRIPTION OF THE PREFERRED EMBODIMENT

Figure 2:
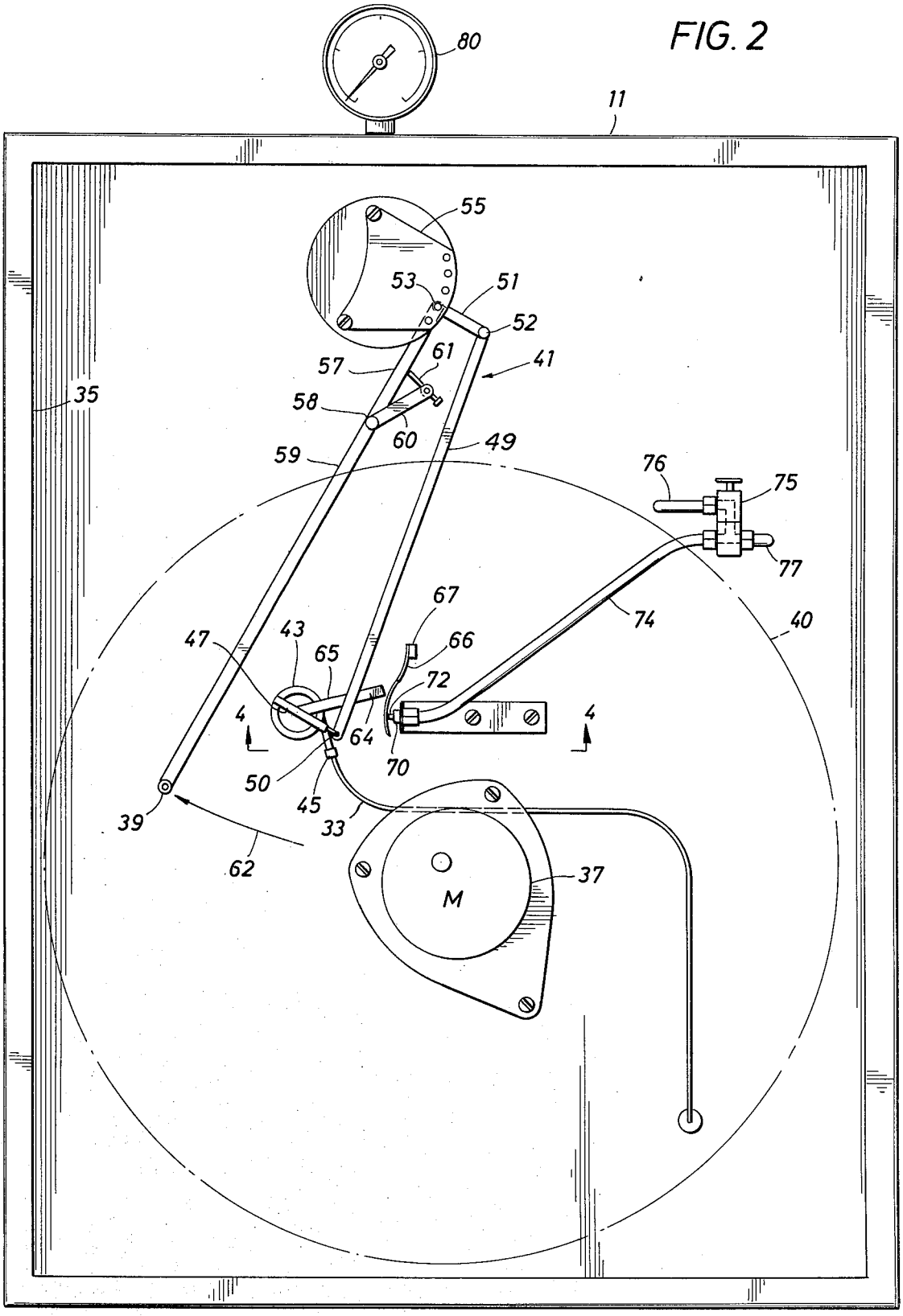
FIG. 2 is a top view of the recording and pressure measuring device of the present invention.

Referring now to the drawings, in FIG. 1 the power tongs are designated by the numeral 20. Tongs 20 apply torque to a pipe (not shown) contained within jaws 21. The torque is applied by means of various mechanisms not pertinent to the present invention driven by a hydraulic motor 22. Hydraulic fluid is supplied to motor 22 through an hydraulic feed line 24 by a pump 23. The hydraulic fluid is returned to pump unit 25 by a return line 26, which deposits the fluid into a fluid tank or reservoir 27.

The torque applied by tongs 20 is measured by means of a hydraulic tension cell 30 attached by a cable 31 between a fixed attachment 32 and tongs 20. As torque is applied by tongs 20, a force is applied to hydraulic tension cell 30. The force, of course, is equal to the torque divided by the length of the moment arm. The force on tension cell 30 causes a proportional hydraulic pressure to be generated therewithin. The hydraulic pressure is communicated to the apparatus 11 of the present invention by an hydraulic line 33.

As will be explained below, apparatus 11 has means for recording the torque applied by tongs 20 and for limiting the amount of such torque. Briefly, means are provided in apparatus 11 such that when the pressure generated by hydraulic tension cell 30, and therefore the torque applied by tongs 20, exceeds a certain level, air from an air feed 15 is delivered through an air line 16 to an air-actuated shunt valve 17. When the torque exceeds the maximum tolerable level, hydraulic fluid is shunted through shunt valve 17 via shunt line 18 between feed line 24 and return line 26, thereby bypassing and deactivating hydraulic motor 22.

Turning now to FIG. 2, in the preferred embodiment, apparatus 11 is mounted in a case 35 which is a box. The recording device of apparatus 11 includes a chart drive 37 and a stylus 39. A chart 40 is driven by chart drive 37 and the torque is recorded thereon by stylus 39. Stylus 39 is operated through a linkage designated generally by the numeral 41 by a pressure sensor 43.

As best seen in FIG. 4, pressure sensor 43 is a tubular helix having a closed end 44 and an open end 45, which is connected to hydraulic line 33. As hydraulic pressure is applied through hydraulic line 33, pressure sensor 43 twists in an amount proportional to such pressure. An arm 47 is attached to pressure sensor 43 and is caused to rotate in an amount proportional to the pressure in pressure sensor 43 and therefore the torque applied by tongs 20. The movement of arm 47 is transmitted to stylus 39 through linkage 41.

Linkage 41 includes a first bar 49 connected to arm 47 at a pivot 50. First bar 49 is connected to a sceond bar 51 at a pivot 52. Second bar 51 is substantially rigidly joined to a shaft 53 that is rotatably mounted in a bracket 55. Also substantially rigidly mounted to shaft 53 is a third bar 57. Third bar 57 is mounted to shaft 53 at a position outwardly from the attachment of second bar 51 such that bars 49 and 50 are below chart 40 and third bar 57 is above chart 40. A stylus bar 59 is attached to second bar 57 at a pivot 58. Stylus bar 59 includes an adjustment portion 60 which includes an adjustment screw 61. The alignment of stylus bar 59 and third bar 57 may be changed by adjustment screw 61 in order to zero stylus 39 on chart 40 to obtain proper readings. It may thus be seen that the rotation of bar 47 is transmitted through linkage 41 to cause stylus bar 59 to swing as indicated by arrow 62.

Also joined to pressure sensor 43 is an operating arm 65. As shown in FIGS. 2 and 4, the end 64 of operating arm 65 is cammingly engaged with a spring 66. Spring 66 is mounted to box 35 on a post 67. As operating arm 65 rotates due to pressure in pressure sensor 43, end 64 cams against the curvature of spring 66, causing spring 66 to move sideways.

The sideways camming of spring 66 causes the closing of an air valve 70 when operating arm 65 rotates a distance corresponding to the maximum permissible torque generated by tongs 20. Valve 70 is mounted to box 35 by a bracket 69. As best seen in FIG. 5, valve 70 includes a valve member 71 having a valve operator 72. Valve member 71 is kept normally lifted from a valve seat 73 by the force of air indicated by the arrows in FIG. 5. Valve member 71 is kept from being blown out of valve 70 by spring 66. Referring again to FIG. 2, air is supplied to valve 70 by an air line 74, which is supplied by a manifold 75. Manifold 75 connects air line 74 with an air inlet 76 and an air outlet 77. Referring now to FIG. 3, air is supplied to air inlet by air feed 15. Air feed 15 is connected through a Tee 79 to a gauge 80, shown in FIG. 2, which enables the operator to determine whether sufficient air pressure is being supplied.

Prior to entering air inlet 76, the air from air feed 15 is cleaned and dried by a filter 28. After filtration, the air is fed to air inlet 76 and to a diaphragm-operated valve 84. Valve 84 is normally closed, and therefore all of the air from air feed 15 is supplied to manifold 75 by air inlet 76. Air outlet 77 is connected to the operating portion of valve 84. When valve 70 closes due to the torque generated by tongs 20, air from air inlet 76 is diverted from air line 74 through manifold 75 to air outlet 77. The increased pressure in air outlet 77 operates valve 84 to open allowing air to flow from air feed 15 to air line 16.

Referring now to FIG. 6, shunt valve 17 is air-actuated and is similar to valve 84. Shunt valve 17 includes a chamber 90 into which air from air line 16 may flow. Chamber 90 has therein a diaphragm 91 that is connected to a valve operator 92. Operator 92 is connected to and operates a valve 93 in shunt line 18. Valve 93 is normally closed by a spring 95 compressed against diaphragm 91 in a housing 96. When air is supplied to chamber 90 by air line 16, the pressure within chamber 90 applied to diaphragm 91 overcomes the force of spring 95, which causes diaphragm 91 and valve operator 92 to lift, thereby opening valve 93. When valve 93 opens, hydraulic fluid is shunted between hydraulic feed line 24 and return line 26, thereby bypassing and deactivating motor 22.

In operation, tongs 20 would be placed in operable position about the pipe. Shunt line 18 with shunt valve 17 therein would be placed between hydraulic feed line 24 and return line 26. Hydraulic tension cell 30 would be connected between tongs 20 and fixed attachment 32 by means of cable 31. Hydraulic line 33 would be connected between tension cell 30 and apparatus 11.

As tongs 20 are operated, the torque applied is converted to a pressure within tension cell 30, which is transmitted by hydraulic line 33 to pressure sensor 43. The amount of torque applied by tongs 20 is recorded on chart 40 by stylus 39, which is operably connected to pressure sensor 43 by linkage 41.

As torque is applied by tongs 20, operating arm 65 will rotate with pressure sensor 43 and cam spring 66 to move sideways. If the torque reaches the maximum level, then spring 66 closes valve 70, thereby diverting air from air line 74 to air outlet 77. The increased air pressure in air outlet 77 causes valve 84 to open, thereby allowing air to flow from air feed 15 to air line 16. The air from air line 16 flows into chamber 90 of shunt valve 17 causing diaphragm 91 to lift and open valve 93. When valve 93 opens, hydraulic fluid flows through shunt line 18 between hydraulic feed line 24 and return line 26. With the hydraulic fluid so shunted, motor 22 is bypassed and thereby deactuated.

It may thus be seen that the apparatus of the present invention enables the operator to keep a continuous record of the amount of torque applied to the pipe. Moreover and more importantly, the apparatus of the present invention automatically deactuates tongs 20 when the torque reaches the maximum desired level. The automatic deactuation feature saves the pipe from being overtorqued, and thereby overcomes the shortcomings of the prior art.

Further modifications and alternative embodiments of the apparatus and system of this invention will be apparent to those skilled in the art in view of this description. Accordingly, this description is to be construed as illustrative only and is for the purpose of teaching those skilled in the art the manner of carrying out the invention. It is to be understood that the form of the invention herewith shown and described are to be taken as the presently preferred embodiment. Various changes may be taken in the shape, size and arrangement of parts. For example, equivalent elements or materials may be substituted for those illustrated and described herein, parts may be reversed, and certain features of the invention may be utilized independently of the use of other features, all as would be apparent to one skilled in the art after having the benefit of this description of the invention.

I claim:

1. Apparatus for limiting the torque applied to a pipe by a set of power tongs wherein said tongs are operated by hydraulic fluid pumped through a feed line to a hydraulic motor in said tongs and returned by a return line, which comprises:

a hydraulic tension cell attached between said tongs and a fixed attachment, whereby torque applied by said tongs causes hydraulic pressure in said hydraulic tension cell;

a helical pressure sensor tube hydraulically connected to said hydraulic tension cell;

and means operated by said pressure sensor tube for shunting said hydraulic fluid between said feed line and said return line and bypassing said motor.

2. The apparatus as claimed in claim 1, wherein shunting means includes:

a shunting line between said feed line and said return line;

a valve in said shunting line;

and means actuated by said pressure sensor tube for opening said shunt valve.

3. The apparatus as claimed in claim 2, wherein said valve opening means includes:

an operating arm attached to said pressure sensor tube such that said hydraulic pressure causes said operating arm to rotate;

an air valve;

means operated by said operating arm for closing said air valve;

and means actuated by the closing of said air valve for opening said shunting valve.

4. The apparatus as claimed in claim 3, wherein said air valve closing means includes:

a spring arm cammingly engaged with said operating arm;

and a valve operator engaged with said spring arm, wherein the rotation of said operating arm in response to said pressure cams said spring arm to operate said valve operator to close said air valve.

5. The apparatus as claimed in claim 3, wherein said shunting valve opening means includes:

an air line supplying air to said air valve;

a normally closed diaphragm operated air valve in said air line downstream from said air valve, said diaphragm operated air valve being operated by said air valve such that when said air valve closes, said diaphragm operated air valve opens;

and a diaphragm valve actuator operably connected to said shunting valve and connected to said air line such that when said diaphragm operated air valve opens, said diaphragm valve actuator opens said shunting valve.

6. The apparatus as claimed in claim 1, including means operated by said hydraulic pressure for recording on a chart the torque applied to said pipe.

7. The apparatus as claimed in claim 6, wherein said torque recording means includes:

a chart drive;

a stylus for marking said chart;

and means for linking said stylus and said pressure sensor tube to move said stylus in response to said hydraulic pressure.

8. Apparatus for limiting the torque applied to a pipe by a set of power tongs wherein said tongs are operated by hydraulic fluid pumped through a feed line to a hydraulic motor in said tongs and returned by a return line, which comprises:

a hydraulic tension cell attached to said tongs and secured to a permanent attachment, whereby torque applied by said tongs causes hydraulic pressure in said hydraulic tension cell;

a helical pressure sensor tube hydraulically connected to said hydraulic tension cell;

an operating arm attached to said pressure sensor tube such that said hydraulic pressure causes said operating arm to rotate;

a spring arm, cammingly engaged with said operating arm;

an air valve, said air valve having a valve member engaged with said spring arm such that when said pressure in said pressure sensor tube causes said operating arm to rotate, said operating arm cams said spring arm to close said air valve;

an air line supplying air to said air valve;

a normally closed first diaphragm operated valve in said air line downstream from said air valve, said first diaphragm operated valve being operated by said air valve such that when said air valve closes, said first diaphragm operated valve opens;

a normally closed second diaphragm operated valve connected between said feed line and said return line and operated by said air line such that when said first diaphragm operated valve opens said second diaphragm operated valve opens to shunt hydraulic fluid between said feed line and return line thereby bypassing said motor.

9. The apparatus as claimed in claim 8, including means operated by said hydraulic pressure for recording the torque applied to said pipe.

* * * * *